US011242875B2

(12) United States Patent
Futa et al.

(10) Patent No.: US 11,242,875 B2
(45) Date of Patent: Feb. 8, 2022

(54) SYSTEM THAT MAINTAINS THE LAST COMMANDED POSITION OF DEVICE CONTROLLED BY A TWO-STAGE, FOUR-WAY ELECTROHYDRAULIC SERVO VALVE UPON POWER INTERRUPTION

(71) Applicant: HONEYWELL INTERNATIONAL INC., Morris Plains, NJ (US)

(72) Inventors: Paul W. Futa, North Liberty, IN (US); Matthew Arend, South Bend, IN (US); Charles Walejewski, South Bend, IN (US); Calin Bondariu, Mishawaka, IN (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 0 days.

(21) Appl. No.: 16/810,068

(22) Filed: Mar. 5, 2020

(65) Prior Publication Data

US 2021/0277920 A1 Sep. 9, 2021

(51) Int. Cl.
*F15B 20/00* (2006.01)
*F15B 13/043* (2006.01)

(52) U.S. Cl.
CPC ..... *F15B 20/002* (2013.01); *F15B 13/0438* (2013.01)

(58) Field of Classification Search
CPC ..... F15B 20/002; F15B 2211/8623; F15B 2211/8752; F15B 2211/40507; F15B 13/0438
See application file for complete search history.

(56) References Cited

U.S. PATENT DOCUMENTS

| | | | | |
|---|---|---|---|---|
| 4,256,017 | A | 3/1981 | Eastman | |
| 5,735,122 | A * | 4/1998 | Gibbons | F15B 15/26 60/406 |
| 5,829,335 | A * | 11/1998 | Ewald | D01G 19/26 91/363 A |
| 6,640,833 | B2 | 11/2003 | Brocard et al. | |
| 7,296,406 | B2 | 11/2007 | Lafferty et al. | |
| 7,475,537 | B2 | 1/2009 | Spickard | |
| 7,836,676 | B2 | 11/2010 | Futa, Jr. et al. | |
| 9,102,415 | B2 * | 8/2015 | Bartov | F15B 11/08 |
| 2007/0199314 | A1 | 8/2007 | Futa, Jr. et al. | |
| 2007/0277670 | A1 | 12/2007 | Spickard | |
| 2008/0230127 | A1 | 9/2008 | Marly | |
| 2008/0296403 | A1 | 12/2008 | Futa, Jr. et al. | |

OTHER PUBLICATIONS

Extended EP search Report for Application No. 21158005.5 dated Jul. 6, 2021.

* cited by examiner

*Primary Examiner* — F Daniel Lopez
(74) *Attorney, Agent, or Firm* — Lorenz & Kopf, LLP

(57) ABSTRACT

A system uses a two-stage electrohydraulic servo valve that includes an additional control port that commands a fail-fixed valve to lock the position of a device in the last commanded position. The additional port is modulated by an existing land on the EHSV valve element, adding little to no complexity. Major technical benefits of the disclosed system are that it adds little to no cost, complexity, size, or weight the device being controlled. The disclosed configuration allows for the use of a relatively small and simple fail-fixed valve, and the control ports on the controlled device keep "drift" to a minimum, when transitioning between normal operating mode and fail-fixed operating mode.

17 Claims, 4 Drawing Sheets

SYSTEM THAT MAINTAINS THE LAST COMMANDED POSITION OF DEVICE CONTROLLED BY A TWO-STAGE, FOUR-WAY ELECTROHYDRAULIC SERVO VALVE UPON POWER INTERRUPTION

TECHNICAL FIELD

The present disclosure generally relates to devices controlled by two-stage electrohydraulic servo valves (EHSVs) and more particularly relates to a system that maintains the last commanded position of a device that is controlled by a two-way, four-stage EHSV upon power interruption.

BACKGROUND

The position of a device, such as an actuator, may be hydraulically controlled by varying the pressures of fluids applied to one or more sections of the actuator. The pressures may, in many instances, be controlled by another device, such as an electrohydraulic servo valve (EHSV). Many EHSVs are implemented as two-stage EHSVs, which use a first stage motor, such as a torque motor, to control the position of a second stage spool. Moving the spool, via the first stage motor, opens and closes various fluid passages to control the pressures connected to the device being controlled.

Depending on the particular end-use environment, it may be desirable to maintain the last commanded position of the device being controlled in the unlikely event of a power interruption to the EHSV. However, when power is interrupted, control pressures can vary and the fluid holding the device in position may flow and allow the device to deviate from the position it was in when the power interruption occurred. While it is known to shift an EHSV to a failsafe position in the event of a power interruption, EHSV second stage spools may also leak and thereby not adequately prevent fluid flows or hold a piston in position. Thus, some systems include a fail-fixed valve between the EHSV and the device being controlled. However, the control of these fail-fixed valves can be relatively complex, and thus, relatively costly, relatively large is size, and relatively weighty. Moreover, known configurations do not address the unique technical challenges that can occur when the EHSV is implemented as a two-way, four-stage EHSV.

Hence, there is a need for a system that maintains the last commanded position of a device that is controlled by a two-way, four-stage EHSV upon power interruption that adds little or no cost, little or no complexity, little or no size, and little or no weight to existing systems. The present invention addresses at least this need.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

In one embodiment, a system includes a fail-fixed valve body, a fail-fixed valve element, and a two-stage electrohydraulic servo valve (EHSV). The fail-fixed valve body includes a first inlet port, a second inlet port, a third inlet port, a first outlet port, and a second outlet port. The fail-fixed valve element is disposed within the fail-fixed valve body and is moveable therein between a first position, in which the first inlet port is in fluid communication with the first outlet port and the second inlet port is in fluid communication with the second outlet port, and a second position, in which the first inlet port is not in fluid communication with the first outlet port and the second inlet port is not in fluid communication with the second outlet port. The two-stage EHSV includes a servo valve body and a servo valve element. The servo valve body includes a supply pressure port, a return pressure port, a head pressure port, a rod pressure port, and a fail-fixed control pressure port. The head pressure port is in fluid communication with the first inlet port, the rod pressure port is in fluid communication with the second inlet port, and the fail-fixed control pressure port is in fluid communication with the third inlet port. The servo valve element is disposed within the servo valve body and is moveable therein between a centered control position and a plurality of non-centered control positions, and is further moveable to an electrical null bias fail-fixed position. In the centered control position, the supply pressure port and the return pressure port are both fluidly isolated from the head pressure port, the rod pressure port, and the fail-fixed control pressure port. In the plurality of non-centered control positions, the supply pressure port and the return pressure port are both fluidly isolated from the fail-fixed control pressure port, and either (i) the supply pressure port is in fluid communication with the head pressure port and the return pressure port is in fluid communication with the rod pressure port or (ii) the supply pressure port is in fluid communication with the rod pressure port and the return pressure port is in fluid communication with the head pressure port. In the electrical null bias fail-fixed position, the supply pressure port is in fluid communication with the fail-fixed control pressure port and the head pressure port, and the return pressure port is in fluid communication with the rod pressure port, whereby the fail-fixed valve element is moved from the first position to the second position.

In another embodiment, a system includes a fail-fixed valve body, a fail-fixed valve element, and a two-stage electrohydraulic servo valve (EHSV). The fail-fixed valve body includes a first inlet port, a second inlet port, a third inlet port, a first outlet port, and a second outlet port. The fail-fixed valve element is disposed within the fail-fixed valve body and is moveable therein between a first position, in which the first inlet port is in fluid communication with the first outlet port and the second inlet port is in fluid communication with the second outlet port, and a second position, in which the first inlet port is not in fluid communication with the first outlet port and the second inlet port is not in fluid communication with the second outlet port. The two-stage EHSV includes a servo valve body, a first flow restriction, a second flow restriction, and a servo valve element. The servo valve body includes a supply pressure port, a return pressure port, a head pressure port, a rod pressure port, and a fail-fixed control pressure port. The head pressure port is in fluid communication with the first inlet port, the rod pressure port is in fluid communication with the second inlet port, and the fail-fixed control pressure port is in fluid communication with the third inlet port. The first flow restriction is formed in the head pressure port. The second flow restriction formed in the rod pressure port. The servo valve element is disposed within the servo valve body and is moveable therein between a centered control position and a plurality of non-centered control positions, and is further moveable to an electrical null bias fail-fixed position. In the centered control position, the supply pressure port and the return pressure port are both fluidly isolated from the head pressure port, the rod pressure port, and the fail-fixed control pressure port. In the plurality of non-centered control positions, the supply pressure port and the return pressure port are both fluidly isolated from the fail-fixed control pressure port, and either (i) the supply pressure port is in fluid communication with the head pressure port and the return pressure port is in fluid communication with the rod pressure port or (ii) the supply pressure port is in fluid communication with the rod pressure port and the return pressure port is in fluid communication with the head pressure port. In the electrical null bias fail-fixed position, the supply pressure port is in fluid communication with the fail-fixed control pressure port and the head pressure port, and the return pressure port is in fluid communication with the rod pressure port, whereby the fail-fixed valve element is moved from the first position to the second position.

In yet another embodiment, a two-stage electrohydraulic servo valve (EHSV) includes a torque motor, a servo valve body, a first flow restriction, a second flow restriction, and a servo valve element. The servo valve body includes a supply pressure port, a return pressure port, a head pressure port, a rod pressure port, and a fail-fixed control pressure port. The first flow restriction is formed in the head pressure port. The second flow restriction is formed in the rod pressure port. The servo valve element is disposed within the servo valve body and is moveable therein between a centered control position and a plurality of non-centered control positions, and is further moveable to an electrical null bias fail-fixed position. The first and second flow restrictions each have a cross-sectional shape, and the cross-sectional shape is an H-shape.

Furthermore, other desirable features and characteristics of the system will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Figure 1:
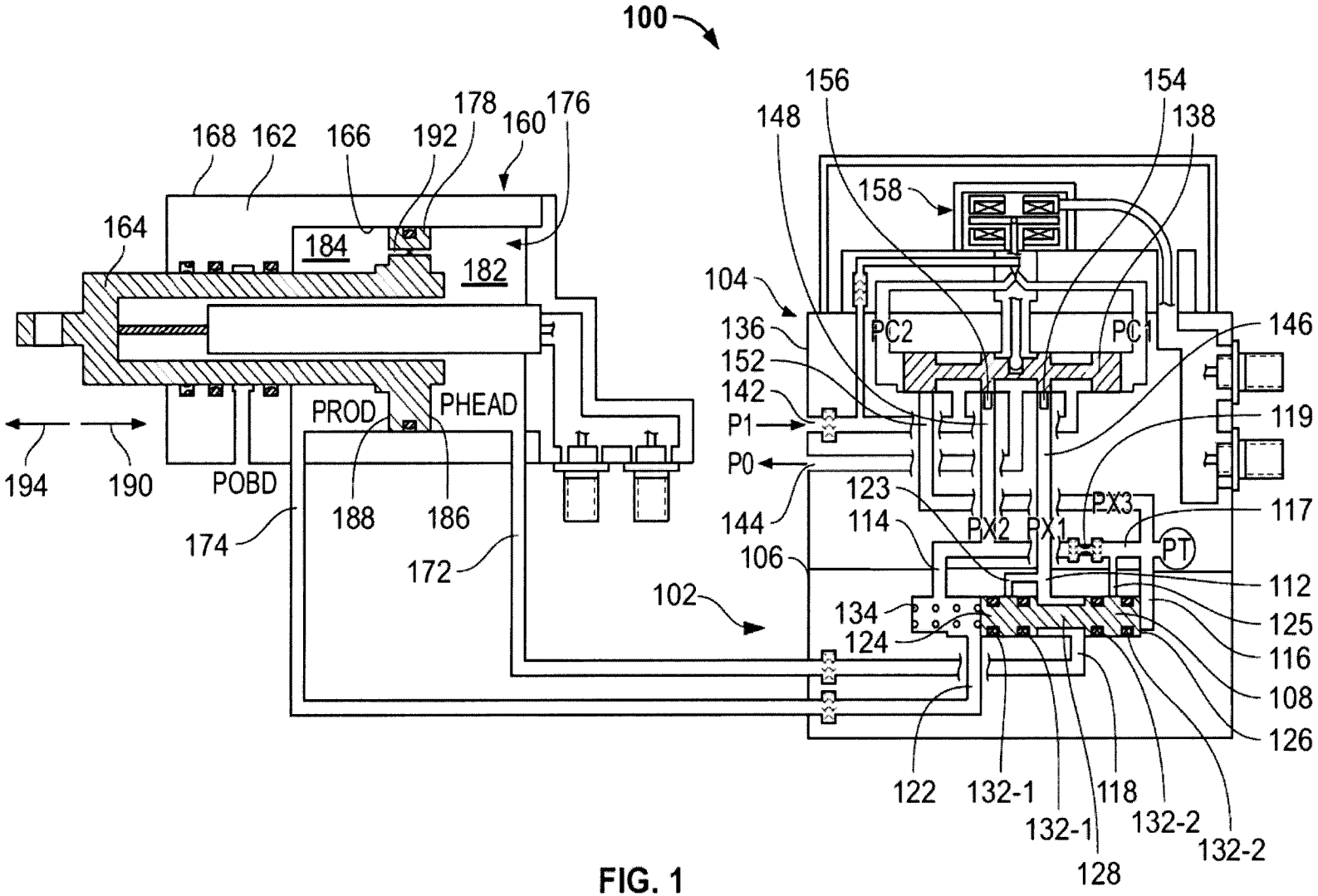
FIG. 1 depicts a schematic representation of one embodiment a system that maintains the last commanded position of a device when the system is operating in a normal operating mode.
Figure 4:
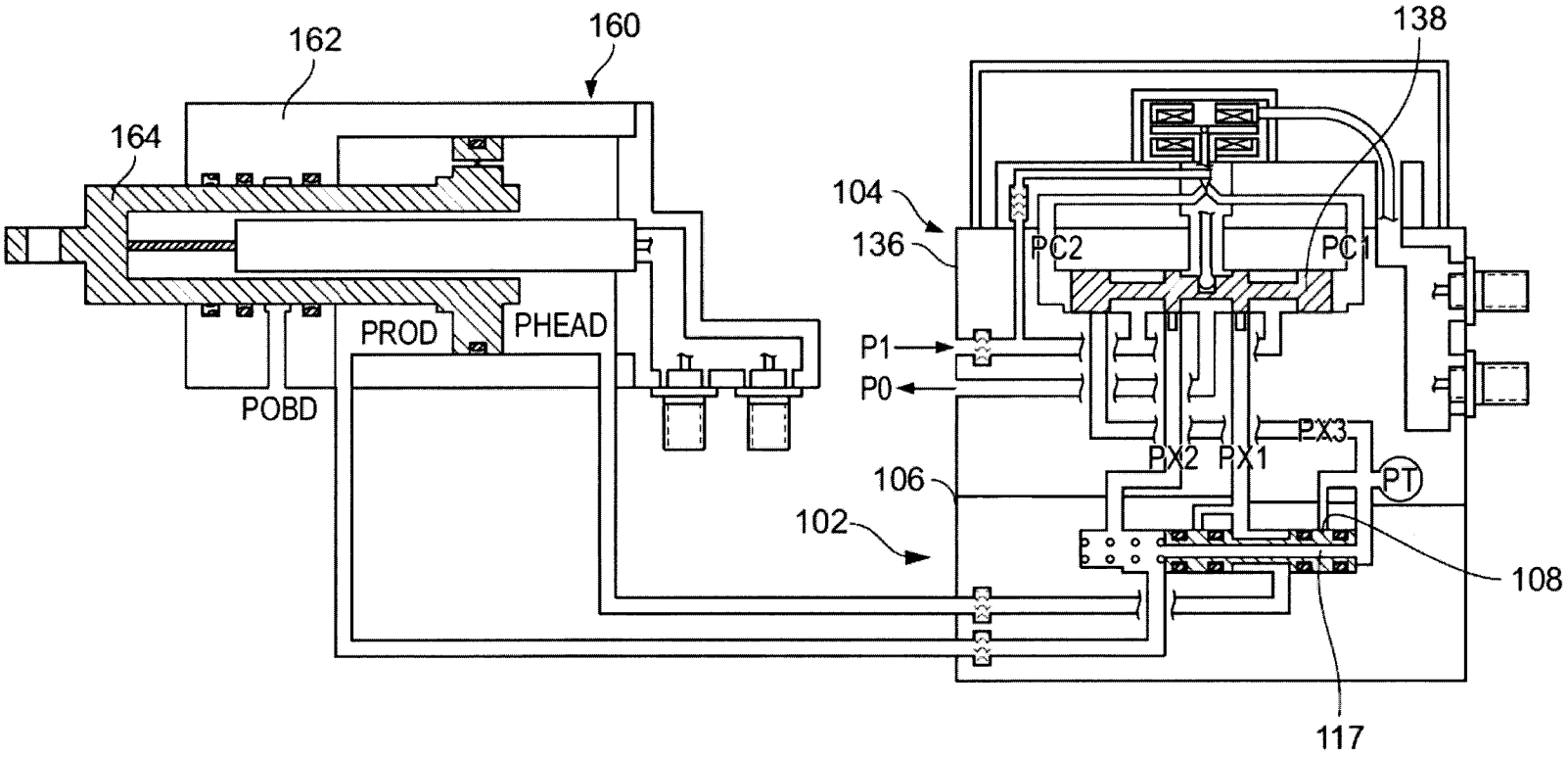
FIG. 4 depicts a schematic representation of another embodiment of a system that maintains the last commanded position of a device when the system is operating in a normal operating mode.

Referring now to FIG. 1, a system 100, and more specifically a system that maintains the last commanded position of a device that is controlled by a two-way, four-stage EHSV upon power interruption, is depicted. The system 100 includes a fail-fixed valve 102 and a two-stage electrohydraulic servo valve (EHSV) 104. The fail-fixed valve 102 includes a fail-fixed valve body 106 and a fail-fixed valve element 108. The fail-fixed valve body 106 includes a first inlet port 112, a second inlet port 114, a third inlet port 116, a first outlet port 118, and a second outlet port 122. In the embodiment depicted in FIGS. 1 and 2, the second inlet port 114 is in fluid communication with the third inlet port 116 via a flow path 117, and a bleed orifice 119 is disposed within the flow path 117. The purpose of this fluid communication will be described further below. It should be appreciated that the flow path 117 could be variously disposed. For example, in FIGS. 1 and 2, the flow path 117 is disposed as an independent channel parallel to the fail-fixed valve body 106. In other embodiments, such as the one depicted in FIG. 4, the flow path 117 is disposed within the fail-fixed valve element 108.

Figure 2:
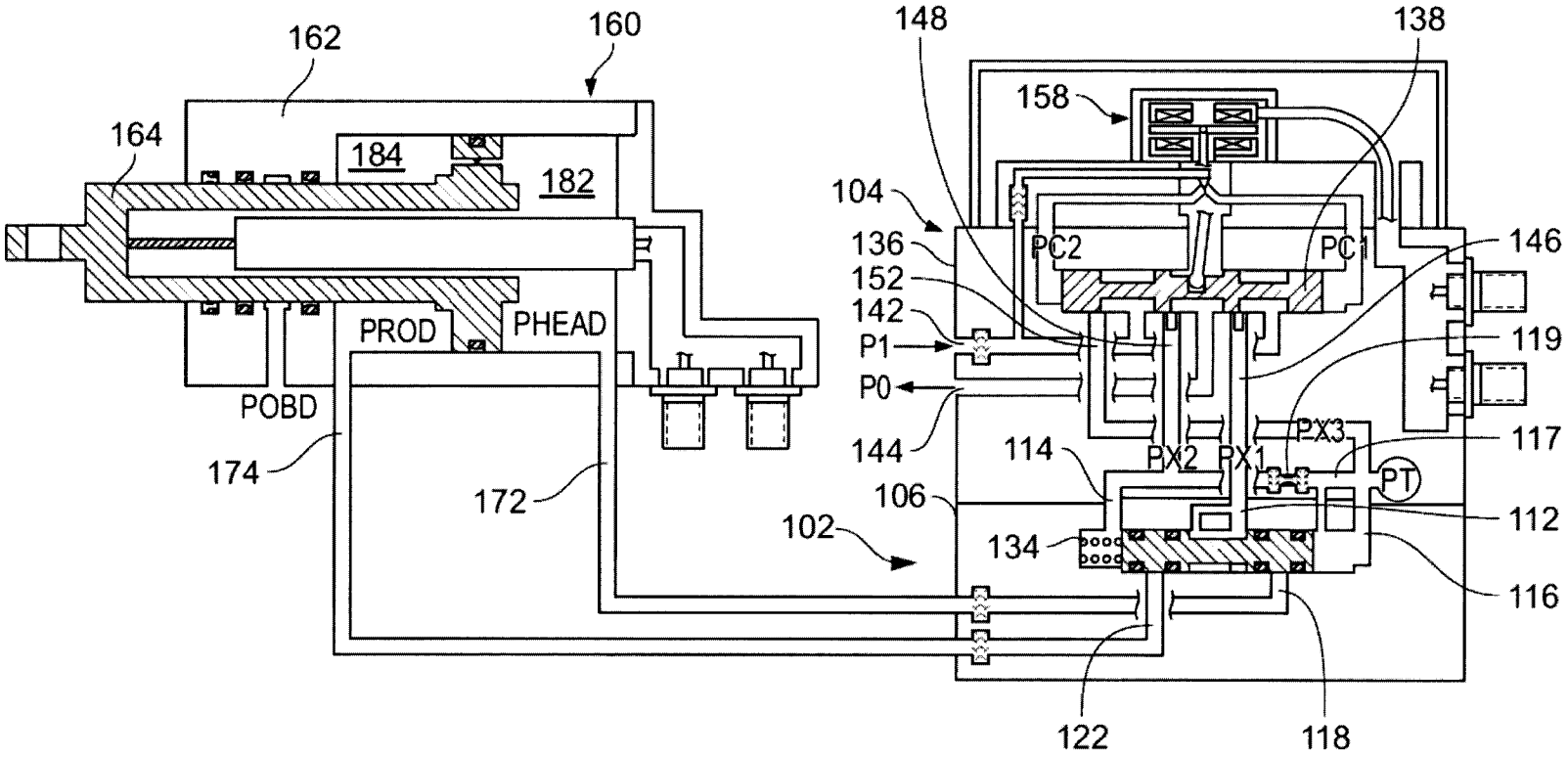
FIG. 2 depicts a schematic representation of the system of FIG. 1 when the system is operating in a fail-fixed operating mode.

The fail-fixed valve element 108 is disposed within the fail-fixed valve body 106 and is moveable within the fail-fixed valve body 106 between a first position and a second position. In the first position, which is depicted in FIG. 1, the first inlet port 112 is in fluid communication with the first outlet port 118 and the second inlet port 114 is in fluid communication with the second outlet port 122. In the second position, which is depicted in FIG. 2, the first inlet port 112 is not in fluid communication with the first outlet port 118 and the second inlet port 114 is not in fluid communication with the second outlet port 122. Although fail-fixed valve element may be variously configured, in the depicted embodiment it includes a first end portion 124, a second end portion 126, and an intermediate portion 128. As FIGS. 1 and 2 clearly depict, the first end portion 124 and the second end portion 126 both have a first diameter, and the intermediate portion 128 has a second diameter that is less than the first diameter.

In the embodiment depicted in FIGS. 1 and 2, the fail-fixed valve 102 also includes a plurality of dynamic seals—a first plurality of dynamic seals 132-1 and a second plurality of dynamic seals 132-2—and a bias spring 134. The first plurality of dynamic seals are mounted on the first end portion 124 of the fail-fixed valve element 108, and the second plurality of dynamic seals 132-2 are mounted on the second end portion 126 of the fail-fixed valve element 108. The bias spring 134, when included, is disposed within the fail-fixed valve body 106 and engages the fail-fixed valve element 108. The bias spring 134 is disposed and configured to supply a bias force to the fail-fixed valve element 108 that urges the fail-fixed valve element 108 toward the first position.

As FIG. 1 depicts, when the fail-fixed valve 102 is in the first position, a first vent channel 123 is disposed between the first plurality of dynamic seals 132-1 and is in fluid communication with the first inlet port 112, and a second vent channel 125 is disposed between the second plurality of dynamic seals 132-2 and is in fluid communication with the third inlet port 116. These vent channels 123, 125 ensure that pressure cannot build up between the first and second plurality of dynamic seals 132-1, 132-2 when the fail-fixed valve 102 is in the first position. Pressure build up could otherwise occur as a result of trapped fluid between these seals 132-1, 132-2 expanding, as a result of temperatures increasing during operation of this device. Elevated pressure between these seals 132-1, 132-2 could increase seal drag, thereby compromising the fail-fixed valve force margin and speed during transition from the first position to the second position.

The two-stage electrohydraulic servo valve (EHSV) 104 includes a servo valve body 136 and a servo valve element 138. The servo valve body 136 includes a supply pressure port 142, a return pressure port 144, a head pressure port 146, a rod pressure port 148, and a fail-fixed control pressure port 152. The supply pressure port 142 is adapted to receive a fluid pressurized to a first pressure (P1), and the return pressure port is adapted to discharge the fluid at a second pressure (P0) that is less than the first pressure. The head pressure port 146 is in fluid communication with the first inlet port 112, the rod pressure port 148 is in fluid communication with the second inlet port 114, and the fail-fixed control pressure port 152 is in fluid communication with the third inlet port 116.

Figure 3:
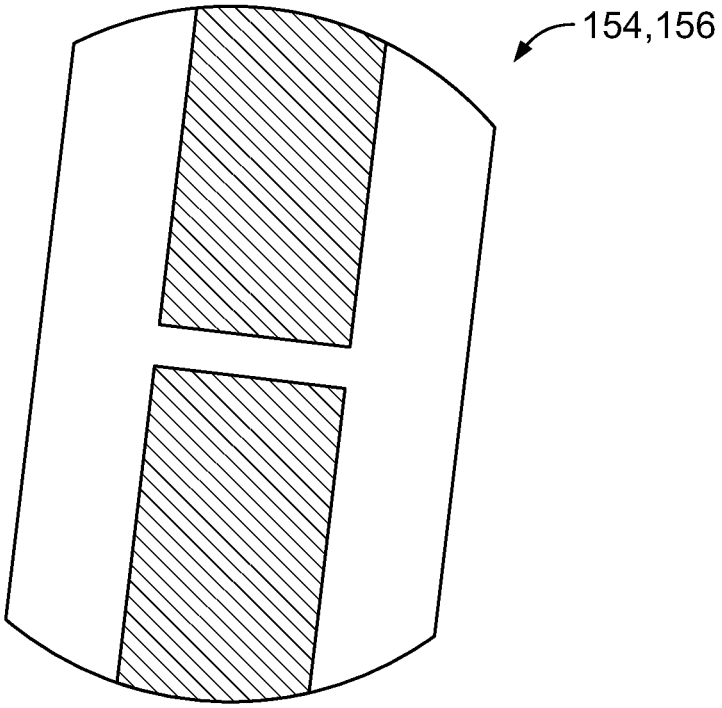
FIG. 3 depicts a cross-sectional view of a flow restriction that may be implemented in the system of FIG. 1.

Before proceeding further, it is noted that a flow limiting configuration may, at least in some embodiments, be implemented in the head pressure port 146 and the rod pressure port 148. In the depicted embodiment, this is implemented by forming a first flow restriction 154 the head pressure port 146, and a second flow restriction 156 in the rod pressure port 148. The first and second flow restrictions 154, 156 each have a cross-sectional shape. In one particular embodiment, which is depicted more clearly in FIG. 3, the cross-sectional shape is an H-shape. The purpose for these flow restrictions, when included, is described further below.

Turning now to the servo valve element 138, it is disposed within the servo valve body 136 and is moveable in the servo valve body 136 between a centered control position, which is the position depicted in FIG. 1, and a plurality of non-centered control positions. In the centered control position, the supply pressure port 142 and the return pressure port 144 are both fluidly isolated from the head pressure port 146, the rod pressure port 148, and the fail-fixed control pressure port 152.

In the plurality of non-centered control positions, the supply pressure port 142 and the return pressure port 144 are both fluidly isolated from the fail-fixed control pressure port 152. In addition, depending upon the command supplied to the EHSV 104 (described further below), either the supply pressure port 142 is in fluid communication with the head pressure port 146 and the return pressure port 144 is in fluid communication with the rod pressure port 148, or the supply pressure port 142 is in fluid communication with the rod pressure port 148 and the return pressure port 144 is in fluid communication with the head pressure port 146.

The servo valve element 138 is also moveable in the servo valve body 136 to an electrical null bias fail-fixed position, which is the position depicted in FIG. 2. In the electrical null bias fail-fixed position, it is seen that the supply pressure port 142 is in fluid communication with both the fail-fixed control pressure port 152 and the head pressure port 146. It is also seen that the return pressure port 144 is in fluid communication with the rod pressure port 148. As a result, the fail-fixed valve element 108 is moved from the first position (FIG. 1) to the second position (FIG. 2).

In the depicted embodiment, the two-stage EHSV 104 additionally includes a torque motor 158, which is responsive to commands received from a non-illustrated control source to control the position the servo valve element 138. In a particular preferred embodiment, the torque motor 158, when included, is implemented using a dual-channel torque motor. It will be appreciated that in other embodiments, various other types valve actuators could be used. No matter the type of valve actuator, however, in the unlikely event that power is interrupted to the EHSV 104 (e.g., the torque motor 158 or other valve actuator), the torque motor 158 (or other valve actuator) is configured to cause the servo valve element 138 to move to the electrical null bias fail-fixed position.

Together, the fail-fixed valve 102 and the EHSV 104 work in conjunction to control the position of a hydraulically operated device and, in the unlikely event that power is interrupted to the EHSV 104, to maintain the last commanded position of the device. Although the hydraulically operated device may vary, one embodiment of such a device, which is a hydraulically operated actuator, is depicted in FIGS. 1 and 2 and, for completeness, will now be described.

The depicted actuator assembly 160 includes an actuator housing 162 and an actuator 164. The actuator housing 162 has an inner surface 166, an outer surface 168, a first actuator pressure port 172, and a second actuator pressure port 174. The inner surface 166 defines an actuator cavity 176, and the first and second actuator pressure ports 172, 174 are spaced apart from each other and extend between the inner and outer surfaces.

The actuator 164 is disposed at least partially in, and is movable within, the actuator cavity 176. The actuator 164 includes a piston 178 that divides the actuator cavity 176 into two cavities—head pressure cavity 182 and a rod pressure cavity 184. The head pressure cavity 182 is in fluid communication with the first outlet port 118 of the fail-fixed valve 102 via the first actuator pressure port 172, and the rod pressure cavity 174 is in fluid communication with the second outlet port 122 of the fail-fixed valve 102 via the second actuator pressure port 174. The piston 178, at least in the depicted embodiment, includes a first side 186, a second side 188, and an orifice 192 that extends between the first and the second sides 186, 188. The orifice 192, which is a flow-limiting orifice, provides fluid communication between the head pressure cavity 182 and the rod pressure cavity 184, and provides a constant low volume bleed flow between the head pressure cavity 182 and the rod pressure cavity 184, which dissipates heat from the actuator 160, particularly if it is maintaining a constant position in a relatively hot environment. It will be appreciated that this bleed flow is not required if heat buildup is not a concern, and thus the piston 178 may be implemented without the orifice 192.

It is noted that if the bleed flow is provided, external loads in the retract direction (indicated by arrow 190 in FIGS. 1 and 2) will not result in any actuator movement when in the fail-fixed operating mode depicted in FIG. 2. This is because actuator movement in the retract direction 190 would result in a reduction of the total combined area of the head pressure and rod pressure cavities 182, 184. Because the fluid in these cavities 182, 184 is relatively incompressible, the actuator 164 cannot retract when the first and second actuator pressure ports 172, 174 are blocked by the fail-fixed valve element 108. However, external forces acting to move the actuator in the extend direction (indicated by arrow 194 in FIGS. 1 and 2) would result in increasing the total combined area of the head pressure and rod pressure cavities 182, 184. A relatively large external force in the extend direction 194 could cavitate the stored fluid in these cavities 182, 184, resulting in the actuator extending. This can be remedied by not including the orifice 192. In such instances, cooling flow could be provided by other means that are understood by those skilled in the art.

Having described the structural configuration of the system 100, and having provided a general description of each of the components of the system 100, a more detailed, yet brief description of how the system 100 operates will now be provided. In doing so, the operation is described in terms of a "normal operating mode," in which power is being supplied to the EHSV 104, and a "fail-fixed operating mode," in which power to the EHSV 104 has been interrupted.

In normal operating mode, which is depicted in FIG. 1, the fail-fixed valve element 108 is in the first position and the two-stage EHSV 104 supplies hydraulic command signals that control the position of a device, such as the actuator 164. As FIG. 1 also depicts, fluid pressure (PX1) free flows through a center annulus in the fail-fixed valve 102 (defined by the intermediate portion 128 of the fail-fixed valve element 108), and exits the fail-fixed valve 102, via the first outlet port 118, as PHEAD pressure. In addition, fluid pressure (PX2) free flows thru the fail-fixed valve 102, past the spring biased first end portion 124 of the fail-fixed valve element 108, and exits the fail-fixed valve 102, via the second outlet port 122, as PROD pressure. The fail-fixed control pressure port 152 is blocked by the EHSV spool. However, the fluid pressure (PX3) in the line connecting the fail-fixed control pressure port 152 to the third inlet port 116 is vented to (PX2) pressure via the flow path 117 and a bleed orifice 119. With (PX2) pressure on both ends of the fail-fixed valve element 108, the bias spring 134 urges the fail-fixed valve element 108 to the first position. As may be appreciated, modulating the pressure levels of PHEAD and PROD, via commands supplied to the EHSV 104, causes the actuator 164 to linearly translate as a result of pressure imbalance.

As previously noted, if power (e.g., electrical command signal) is interrupted to the EHSV 104, the system 100 enters the fail-fixed operating mode. In the absence of electrical power, the EHSV 104, and more specifically the torque motor 158, is null biased such that high supply pressure (P1) is directed to (PC1) and (PC2) pressure is vented vent to return pressure (P0). This causes the servo valve element 138 to move to the electrical null bias fail-fixed position (FIG. 2). This in turn causes (PX1) and (PX3) pressures to increase to the level of supply pressure (P1), and (PX2) pressure to lower to the return pressure level (P0). The bleed orifice 119 in the flow path 117 restricts (PX3) high pressure from flowing to (PX2), thereby creating a pressure imbalance on the fail-fixed valve element 108. The pressure imbalance overcomes the force of the bias spring 134 and urges the fail-fixed valve element 108 to the second position. In this position, the dynamic seals 132 on the fail-fixed valve element 108 block fluid communication between (PX1) and (PHEAD), and between (PX2) and (PROD). Because (PROD) and (PHEAD) are blocked, the actuator 164 is hydraulically locked within a tolerance of its last commanded position.

As may be appreciated from the above description, the (PX2) pressure conduit implements a dual use. In the normal operating mode, (PX2) is the source of (PROD) pressure. In the fail-fixed operating mode, (PX2) pressure become a low-pressure vent that allows the fail-fixed valve element to move from the first position to the second position. This configuration negates the need for additional dynamic seals and/or pressure regions to create the pressure imbalance needed to move the fail-fixed valve element from the first to the second position.

It was previously noted that the first and second flow restrictions 154, 156 may be implemented in the head pressure port 146 and the rod pressure port 148, respectively. These flow restrictions 154, 156 limit the amount the actuator 164 may drift when the system 100 is transitioning from the normal operating mode to the fail-fixed operating mode. With a traditional port, as the servo valve element 138 transitions to the electrical null bias fail-fixed position, the head pressure port 146 and the rod pressure port 148 could continue increasing in area prior to movement of the fail-fixed valve element 108. This could result in an undesirably greater displacement of the actuator 164 when transitioning between the normal operating mode and the fail-fixed operating mode.

The system disclosed herein uses a two-stage EHSV that incorporates an additional control port (the fail-fixed control pressure port 152) that commands the fail-fixed valve to lock the piston in the last commanded position. The additional port is modulated by an existing land on the EHSV valve element 138, adding little to no complexity. Major technical benefits of the disclosed system are that it adds little to no cost, complexity, size, or weight the device being controlled. The disclosed configuration allows for the use of a relatively small and simple fail-fixed valve, and the control ports on the controlled device keep "drift" to a minimum, when transitioning between normal operating mode and fail-fixed operating mode.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A system, comprising:

a fail-fixed valve body including a first inlet port, a second inlet port, a third inlet port, a first outlet port, and a second outlet port;

a fail-fixed valve element disposed within the fail-fixed valve body and moveable therein between a first position, in which the first inlet port is in fluid communication with the first outlet port and the second inlet port is in fluid communication with the second outlet port, and a second position, in which the first inlet port is not in fluid communication with the first outlet port and the second inlet port is not in fluid communication with the second outlet port; and a two-stage electrohydraulic servo valve (EHSV) including:

a servo valve body including a supply pressure port, a return pressure port, a head pressure port, a rod pressure port, and a fail-fixed control pressure port, the head pressure port in fluid communication with the first inlet port, the rod pressure port in fluid communication with the second inlet port, the fail-fixed control pressure port in fluid communication with the third inlet port, and a servo valve element disposed within the servo valve body and moveable therein between a centered control position and a plurality of non-centered control positions, and further moveable to an electrical null bias fail-fixed position, wherein:

in the centered control position, the supply pressure port and the return pressure port are both fluidly isolated from the head pressure port, the rod pressure port, and the fail-fixed control pressure port, in the plurality of non-centered control positions, the supply pressure port and the return pressure port are both fluidly isolated from the fail-fixed control pressure port, and either (i) the supply pressure port is in fluid communication with the head pressure port and the return pressure port is in fluid communication with the rod pressure port or (ii) the supply pressure port is in fluid communication with the rod pressure port and the return pressure port is in fluid communication with the head pressure port, and in the electrical null bias fail-fixed position, the supply pressure port is in fluid communication with the fail-fixed control pressure port and the head pressure port, and the return pressure port is in fluid communication with the rod pressure port, whereby the fail-fixed valve element is moved from the first position to the second position.

2. The system of claim 1, further comprising:

a bias spring disposed within the fail-fixed valve body and engaging the fail-fixed valve element, the bias spring supplying a bias force to the fail-fixed valve element that urges the fail-fixed valve element toward the first position.

3. The system of claim 1, wherein the fail-fixed valve element comprises:

a first end portion;

a second end portion; and an intermediate portion, wherein:

the first end portion and the second end portion have a first diameter, the intermediate portion has a second diameter, and the second diameter is less than the first diameter.

4. The system of claim 1, further comprising:

a first plurality of dynamic seals mounted on the first end portion of the fail-fixed valve element; and a second plurality of dynamic seals mounted on the second end portion of the fail-fixed valve element.

5. The system of claim 1, further comprising:

a first flow restriction formed in the head pressure port; and a second flow restriction formed in the rod pressure port.

6. The system of claim 1, wherein the two-stage EHSV further comprises a torque motor, the torque motor coupled to the servo valve body.

7. The system of claim 6, wherein the torque motor is a dual-channel torque motor.

8. The system of claim 1, wherein the rod pressure port is in fluid communication with the fail-fixed control pressure port via a flow path.

9. The system of claim 8, further comprising:

a bleed orifice disposed within the flow path.

10. The system of claim 1, further comprising:

an actuator housing having an inner surface, an outer surface, a first actuator pressure port, and a second actuator pressure port, the inner surface defining an actuator cavity, the first and second actuator pressure ports spaced apart from each other and extending between the inner and outer surfaces; and an actuator disposed at least partially in, and movable within, the actuator cavity, the actuator including a piston that divides the actuator cavity into a variable head pressure cavity and a variable rod pressure cavity, wherein:

the first actuator pressure port is in fluid communication with the variable head pressure cavity and the first outlet port, and the second actuator pressure port is in fluid communication with the variable rod pressure cavity and the second outlet port.

11. The system of claim 10, wherein the piston includes:

a first side, a second side, and an orifice that extends between the first side and the second side and provides fluid communication between the variable head pressure cavity and the variable rod pressure cavity.

12. A system, comprising:

a fail-fixed valve body including a first inlet port, a second inlet port, a third inlet port, a first outlet port, and a second outlet port;

a fail-fixed valve element disposed within the fail-fixed valve body and moveable therein between a first position, in which the first inlet port is in fluid communication with the first outlet port and the second inlet port is in fluid communication with the second outlet port, and a second position, in which the first inlet port is not in fluid communication with the first outlet port and the second inlet port is not in fluid communication with the second outlet port; and a two-stage electrohydraulic servo valve (EHSV) including:

a servo valve body including a supply pressure port, a return pressure port, a head pressure port, a rod pressure port, and a fail-fixed control pressure port, the head pressure port in fluid communication with the first inlet port, the rod pressure port in fluid communication with the second inlet port, the fail-fixed control pressure port in fluid communication with the third inlet port and in fluid communication with the rod pressure port via a flow path, the flow path having a bleed orifice disposed therein, a first flow restriction formed in the head pressure port, a second flow restriction formed in the rod pressure port, a servo valve element disposed within the servo valve body and moveable therein between a centered control position and a plurality of non-centered control positions, and further moveable to an electrical null bias fail-fixed position, and a dual-channel torque motor coupled to the servo valve body, wherein:

in the centered control position, the supply pressure port and the return pressure port are both fluidly isolated from the head pressure port, the rod pressure port, and the fail-fixed control pressure port, in the plurality of non-centered control positions, the supply pressure port and the return pressure port are both fluidly isolated from the fail-fixed control pressure port, and either (i) the supply pressure port is in fluid communication with the head pressure port and the return pressure port is in fluid communication with the rod pressure port or (ii) the supply pressure port is in fluid communication with the rod pressure port and the return pressure port is in fluid communication with the head pressure port, and in the electrical null bias fail-fixed position, the supply pressure port is in fluid communication with the fail-fixed control pressure port and the head pressure port, and the return pressure port is in fluid communication with the rod pressure port, whereby the fail-fixed valve element is moved from the first position to the second position.

13. The system of claim 12, further comprising:

a bias spring disposed within the fail-fixed valve body and engaging the fail-fixed valve element, the bias spring supplying a bias force to the fail-fixed valve element that urges the fail-fixed valve element toward the first position.

14. The system of claim 12, wherein the fail-fixed valve element comprises:

a first end portion;

a second end portion; and an intermediate portion, wherein:

the first end portion and the second end portion have a first diameter, the intermediate portion has a second diameter, and the second diameter is less than the first diameter.

15. The system of claim 12, further comprising:

a first plurality of dynamic seals mounted on the first end portion of the fail-fixed valve element; and a second plurality of dynamic seals mounted on the second end portion of the fail-fixed valve element.

16. The system of claim 12, further comprising:

an actuator housing having an inner surface, an outer surface, a first actuator pressure port, and a second actuator pressure port, the inner surface defining an actuator cavity, the first and second actuator pressure ports spaced apart from each other and extending between the inner and outer surfaces; and an actuator disposed at least partially in, and movable within, the actuator cavity, the actuator including a piston that divides the actuator cavity into a variable head pressure cavity and a variable rod pressure cavity, wherein:

the first actuator pressure port is in fluid communication with the variable head pressure cavity and the first outlet port, and the second actuator pressure port is in fluid communication with the variable rod pressure cavity and the second outlet port.

17. The system of claim 16, wherein the piston includes:

a first side, a second side, and an orifice that extends between the first side and the second side and provides fluid communication between the variable head pressure cavity and the variable rod pressure cavity.

* * * * *